US007336909B2

(12) United States Patent
Yamazaki

(10) Patent No.: US 7,336,909 B2
(45) Date of Patent: Feb. 26, 2008

(54) PRINTER

(75) Inventor: Yoji Yamazaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 199 days.

(21) Appl. No.: 11/337,442

(22) Filed: Jan. 24, 2006

(65) Prior Publication Data

US 2006/0165421 A1 Jul. 27, 2006

(30) Foreign Application Priority Data

Jan. 26, 2005 (JP) ..... 2005-017579

(51) Int. Cl.
*G03G 15/00* (2006.01)

(52) U.S. Cl. ..... 399/9; 399/15

(58) Field of Classification Search ..... 399/9, 399/8, 15

See application file for complete search history.

(56) References Cited

U.S. PATENT DOCUMENTS

2005/0117927 A1* 6/2005 Tanaka et al.

FOREIGN PATENT DOCUMENTS

JP 2001-334707 12/2001

* cited by examiner

*Primary Examiner*—Susan Lee
(74) *Attorney, Agent, or Firm*—Rabin & Berdo, P.C.

(57) ABSTRACT

A printer receives print information from a host apparatus. An image memory stores image data produced from the print information. A total quantity of output detector determines a total quantity of output that should be printed. A reference quantity storing section stores a reference quantity. A comparing section compares the reference quantity with the total quantity of output to determine whether the total quantity of output is larger than the reference quantity. If the total quantity of output is larger than the reference quantity, a controller reads a fraction of the image data from the image memory and sends a first command to a printing section. The first command causes the printing section to perform test printing where the printing section prints the fraction of the image data and then enters a standby state.

13 Claims, 16 Drawing Sheets

PRINTER

BACKGROUND OF THE INVENTION

1. Field of the Invention

The present invention relates to a printer.

2. Description of the Related Art

A conventional printer is capable of printing a plurality of pages of the same image. In printing one or more pages, the printer operates to first print a predetermined fraction of the total number of pages so that a user can check the print results before the total number of pages are printed. One such printer is disclosed in Japanese Patent Laid-Open No. 2001-334707. A user operates an operation panel of a personal computer (PC) to select either an editing mode or a normal printing mode. For test printing, the user selects the editing mode, and inputs a command for test printing, which in turn is transmitted from the personal computer to the printer.

However, with the aforementioned conventional printer, if the user inadvertently selects the normal printing mode rather than the editing mode, the print results may be poor. This wastes a large amount of consumable items such as paper and developer, especially when a print job includes a plurality of copies each of which has a plurality of pages.

SUMMARY OF THE INVENTION

An object of the invention is to solve the aforementioned problems of the conventional printers.

Another object of the invention is to provide a printer in which test printing is performed so that a user can check the print result of one copy of a print job before printing the all of the copies.

Still another object of the invention is to provide a printer that prevents waste of consumable items such as paper and developer.

A printer that processes print information received-from a host apparatus. An image storing section stores image data produced from the print information. A printing section prints the image data. A total-quantity-of-output detector determines a total quantity of output that should be printed out. A reference quantity storing section stores a reference quantity. A comparing section compares the reference quantity with the total quantity of output to determine whether the total quantity of output is larger than the reference quantity. A control section controls the printing section. If the total quantity of output is larger than the reference quantity, the control section reads a fraction of the image data from the image storing section and causes the printing section to perform test printing where the printing section prints the fraction of the image data and then enters a standby state in which the printing section waits for a rest of the image data.

The total quantity of output is a total number of copies of the image data that should be printed and the fraction of the image data is a copy of the image data that should be printed.

The printer further includes a user's permission storing section that obtains a user's command after the printing section enters the standby state. The control section controls the printing section to print the rest of the image data in response to the user's command.

The printer further includes a user's permission storing section that obtains a user's command after the printing section enters the standby state. The control section controls the image storing section to erase the rest of the image data in response to the-user's command.

The printer further includes a test printing notifying section that notifies the host apparatus that test printing is performed and that the printer enters a standby state after the test printing.

The printer further includes an operation section through which a user sets the reference quantity.

The printer further includes an input section through which the reference quantity is received from a host apparatus, and a reference quantity detecting section that stores the reference quantity received through the input section. The storing section stores the received reference quantity into the reference quantity storing section.

The printer further includes a timer that starts timing when the printing section enters the standby state. When the timer reaches a time, the control section controls the printing section to print the rest of the image data.

The printer further includes a timer that starts timing when the printing section enters the standby state. When the timer reaches a time, the control section controls the image storing section to erase the rest of the image data.

When the printing section is in the standby state, if the printer receives image data from another user, the control section erases the rest of the image data.

When the printing section is in the standby state, if the printer receives print information from another user, the control section controls the printing section to print the rest of the image data.

The printer further includes a medium-type detecting section, a medium-type selecting section, and a reference quantity setting section. The medium-type detecting section detects a type of print medium from the image data. The medium-type selecting section selects the type of print medium whose reference quantity is stored into the reference quantity storing section. The reference quantity setting section sets the reference quantity to the reference quantity storing section. The reference quantity storing section notifies the comparing section of the received reference quantity that corresponds to the type of print medium detected by the medium-type detecting section.

The printer further includes a file name detecting section, a file name storing section, a user-name detector, a user-name storing section, a test printing history storing section, and a test printing history deciding section. The file name detecting section detects a name of a data file received from the host apparatus. The file name storing section stores the name of the data file. The user-name detector obtains information on a user. The user-name storing section stores information on the user. The test printing history storing section stores history information on previously performed test printing. The test printing history deciding section decides whether the test printing should be performed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

{Configuration}

Figure 1:
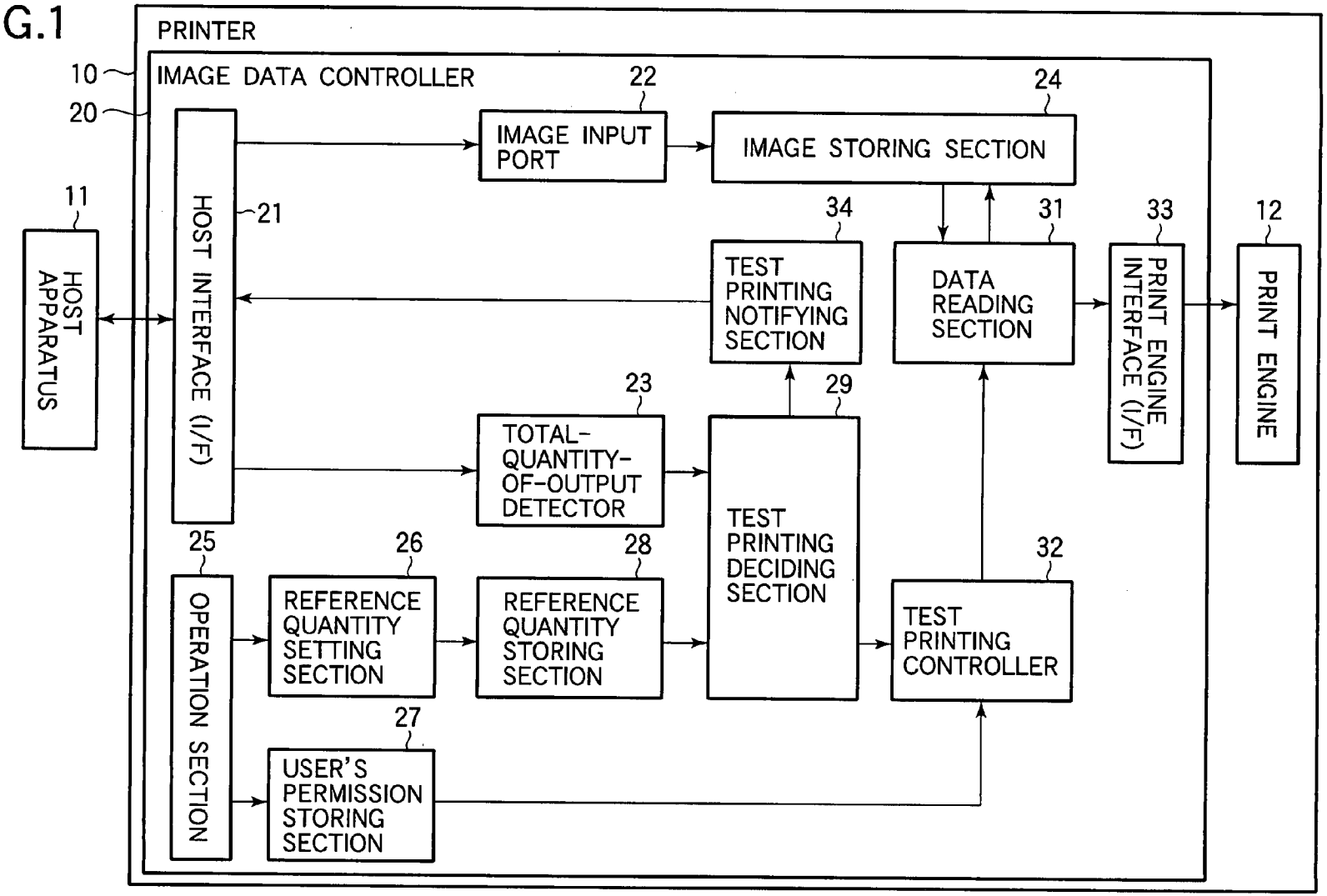
FIG. 1 is a block diagram illustrating a printer according to a first embodiment of the invention.

FIG. 1 is a block diagram illustrating a printer according to a first embodiment of the invention.

Referring to FIG. 1, a printer 10 is connected to a host apparatus 11 that commands a printing operation and various settings for the printing operation. The host apparatus 11 is a computer that primarily includes a device such as a CPU or MPU for performing arithmetic operations, a memory such as a magnetic disk or a semiconductor memory, an input device such as a key board, a mouse, or a touch panel, a display such as a CRT or a liquid crystal display, and a communication interface. The host apparatus 11 may be of any known type such as a personal computer, a server, a personal digital assistant (PDA), an electronic notebook, or a game machine provided that the host apparatus 11 is capable of producing print information including image data in the format that can be printed by the printer 10. Further, the printer 10 may be of any known type such as an ink jet printer, an electrophotographic printer, or a thermal, printer provided that the printer is capable of printing image data received from the host apparatus 11 on the print medium (e.g., paper). The printer 10 may be either of a color printer, a monochrome printer, or a composite apparatus with functions of a printer, facsimile machine, and copying machine. The communication line that connects between the printer 10 and the host apparatus 11 may be a universal serial bus (USB) cable or may be of any network such as an intranet, local area network (LAN), wide area network (WAN), or Internet protocol (IP).

The printer 10 includes an image data controller 20 and a print engine 12. Based on the print information including image data received from the host apparatus 11, the image data controller 20 produces image data in accordance with printer settings. The image data controller 20 is connected to the host apparatus 11 via a host interface (I/F) 21. The image input port 22 receives image data from print information received through the host I/F 21. A total-quantity-of-output detector 23 analyzes the received image data to detect the total quantity of output, i.e., the total number of pages or the total number of copies that should be printed. An image storing section 24 stores received image data. A user operates an operation section 25 to manipulate various settings stored in the printer 10. For example, when the printer 10 is in a standby state after a printing operation, the user inputs a user's permission via the operation section 25 so that a user's permission storing section 27 stores the user's permission. A reference quantity setting section 26 causes a reference quantity storing section 28 to store a reference quantity that should be printed, on the basis of which a decision is made to determine whether the test printing should be performed. The reference quantity storing section 28 stores the reference quantity set by the user. A test printing deciding section 29 compares the total-quantity-of-output with reference quantity to determine whether the test printing should be performed. A data reading section 31 reads the image data from the image storing section 24, and transfers the image data to the print engine 12. A test printing controller 32 controls the reading of the image data from the image storing section 24 during printing. A print engine interface (I/F) 33 connects the image data controller 20 to the print engine 12. A test printing notifying section 34 notifies the host I/F 21 that the test printing will be performed and the printer 10 will enter a standby state after printing.

When the image information is received from the host apparatus 11, the image data in the image information is transmitted to the image input port 22 through the host I/F 21 while information on the total-quantity-of-output is transmitted to the total-quantity-of-output detector 23. The image data is transmitted to the image storing section 24 through the image input port 22, and is stored into the image storing section 24.

The user operates the operation section 25 to cause the reference quantity setting section 26 to set a desired value of the reference quantity to the reference quantity storing section 28. The test printing deciding section 29 compares the total-quantity-of-output detected by the total-quantity-of-output detector 23 with the reference quantity stored in the reference quantity storing section 28 to determine whether the test printing should be performed. If the test printing deciding section 29 has determined that the test printing should be performed, then the test printing controller 32 controls the data reading section 31 to read the image data from the image storing section 24 for a fraction of copies, for example, one copy, and then to enter a standby state. At the same time, the test printing deciding section 29 notifies the test printing notifying section 34 that the test printing will be performed, and then the test printing notifying section 34 notifies the host apparatus 11 that the test printing will be performed and the printer 10 will enter a standby state. If the test printing deciding section 29 has determined that the test printing should not be performed, then the test printing controller 32 controls the image data reading section 31 to read the image data from the image storing section 24 for the total-quantity-of-output that should be printed.

The image data read is by the data reading section 31 and is transferred to the print engine 12 via the print engine interface 33.

When the printer 10 is in the standby state after printing one copy, the user inputs through the operation section 25 information (i.e., a user's permission) on whether the remaining quantity of output should be printed. This information is stored into the user's permission storing section 27, and is then sent to the test printing controller 32, which in turn controls the data reading section 31 to process the remaining quantity of output.

The total-quantity-of-output detector 23 may also serve as a means that determines the number of pages to be printed. The reference quantity setting section 26 may serve as a means that sets the number of test pages as a reference for determining whether test printing should be performed. The reference quantity storing section 28 may also serve as a storing section that stores the number of test pages. The test printing deciding section 29 may also serve as a comparator that compares the total number of pages to be printed with the number of test pages, thereby determining whether the test printing should be performed. If the test printing deciding section 29 has determined that the total number of pages to be printed is large than the number of test pages, the test printing controller 32 controls the data reading section 31 and the print engine 12 such that the data reading section 31 reads a fraction of image data from image storing section 24, e.g., the first one page of the print job, and the print engine 12 prints the fraction of image data.

{Operation of Printer}

Figure 2:
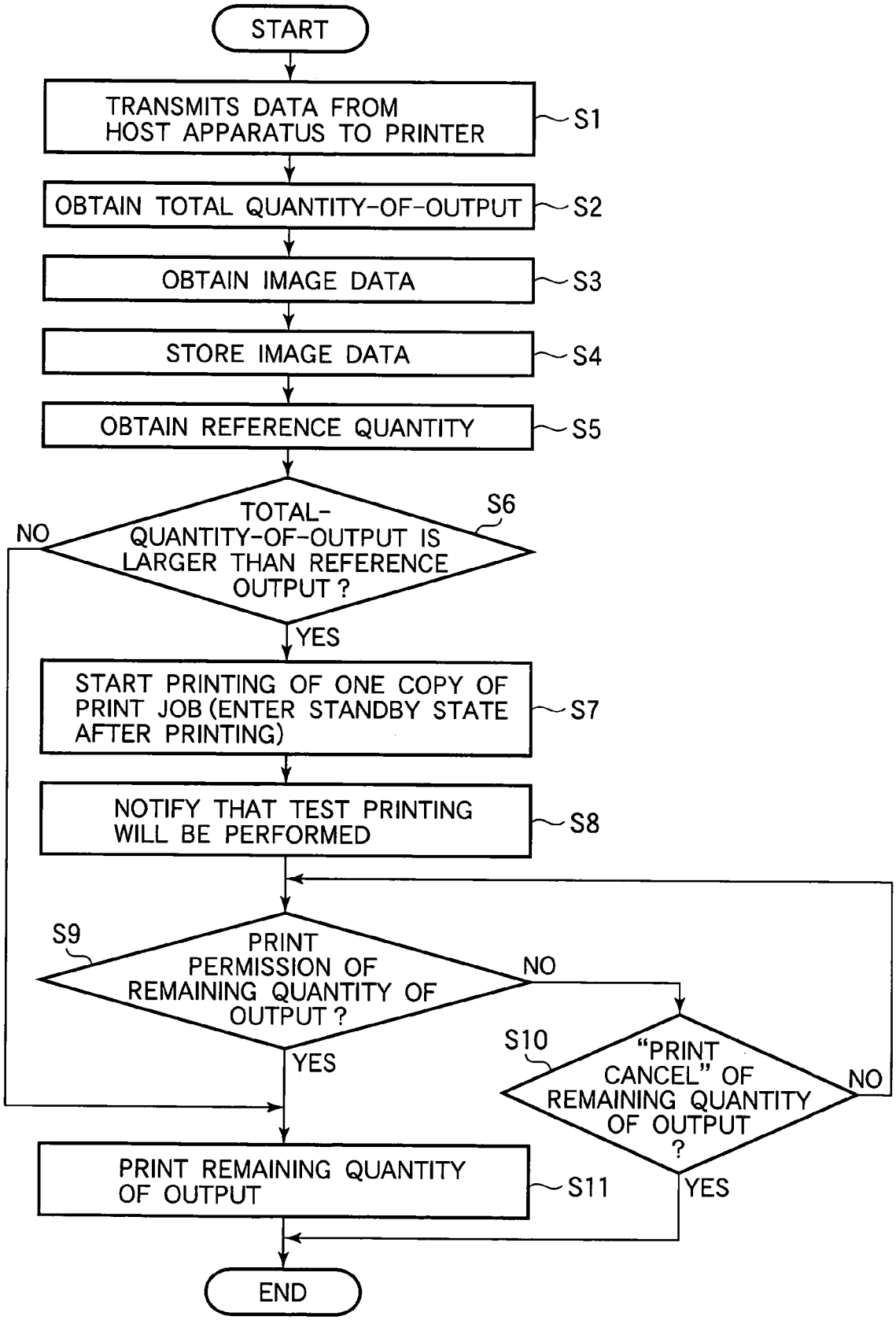
FIG. 2 is a flowchart illustrating the operation of a printer according to the first embodiment.

FIG. 2 is a flowchart illustrating the operation of the printer 10 of the aforementioned configuration. The operation of the printer 10 will be described.

The host apparatus 11 transmits image information including image data generated in the host apparatus 11 to the printer 10. The total-quantity-of-output detector 23 in the printer 10 extracts information on the total-quantity-of-output from the image information received via the host I/F 21. The image input port 22 obtains the image data from the image information received through the host I/F 21. The image storing section 24 stores the image data that the image input port 22 obtained. The reference quantity storing section 28 obtains the reference quantity and stores it. This reference quantity has been set by the user through the operation section 25 and the reference quantity setting section 26.

Subsequently, a test printing deciding section 29 receives the total-quantity-of-output from the total-quantity-of-output detector 23, and the reference quantity from in the reference quantity storing section 28. Then, the test printing deciding section 29 compares the total-quantity-of-output with the reference quantity to determine whether the total-quantity-of-output is larger than the reference quantity. If the total-quantity-of-output is larger than the reference quantity, it is determined that the test printing should be performed. If the total-quantity-of-output is not larger than the reference quantity, it is determined that the test printing need not be performed. Thus, the remaining quantity of output is printed, and then the program ends.

If the test printing should be performed, the test printing controller 32 controls the data reading section 31 to enter the standby state after it has read image data for the first one copy from the image storing section 24. In other words, the data reading section 31 reads the image data from the image storing section 24, and then transfers the image data to the print engine 12 through the print engine interface 33. Then, the print engine 12 enters the standby state.

Upon receiving a decision result from the test printing deciding section 29, the test printing notifying section 34 notifies the host apparatus 11 via the host I/F 21 that the test printing will be performed and the printer 10 will enter a standby state.

When the data reading section 31 enters the standby state after printing one copy, the user's permission storing section 27 obtains a user's permission from the operation section 25. The test printing controller 32 determines whether the remaining quantity of output should be printed. In other words, the test printing controller 32 determines whether the user's permission storing section 27 holds a print permission for the remaining quantity of output as the user's permission. If the user's permission storing section 27 holds the print permission for the remaining quantity of output, the test printing controller 32 determines that the remaining quantity of output is ready to print. Then, the test printing controller 32 controls the data reading section 31 to print the remaining quantity of output. The data reading section 31 reads the image data from the image storing section 24 for the remaining quantity of output, and outputs the data to the print engine 12 through the print engine interface 33. After completing the printing of the remaining quantity of output, the program ends.

If the user's permission storing section 27 does not hold the print permission for the remaining quantity of output, the test printing controller 32 determines that the remaining quantity of output should not be printed yet, and then determines whether the user's permission storing section 27 holds a "print cancel". If the user's permission storing section 27 holds the "print cancel," then the test printing controller 32 clears the data reading section 31, and cancels the printing of the remaining quantity of output. If the user's permission storing section 27 does not hold the "print cancel," then a check is made to determine whether the user's permission storing section 27 holds the print permission for the remaining quantity of output. If the user's permission storing section 27 has not held print permission for the remaining quantity of output yet, the test printing controller 32 waits until the user's permission storing section 27 holds the print permission for the remaining quantity of output.

It should be noted that when the value of the reference quantity of output is "1", if a-plurality of copies are to be printed, the test printing is always performed.

The following is a brief description of the flowchart in FIG. 2.

Step S1: The host apparatus 11 transmits the data to the printer. 10.

Step S2: The total-quantity-of-output detector 23 obtains the information on the total-quantity-of-output.

Step S3: The image input port 22 obtains the image data.

Step S4: The image storing section 24 stores the image data.

Step S5: The test printing deciding section 29 obtains the reference quantity from the reference quantity storing section 28.

Step S6: The test printing deciding section 29 determines whether the total-quantity-of-output is larger than the reference quantity. If the total-quantity-of-output is larger than the reference quantity, the program proceeds to step S7. If the total-quantity-of-output is not larger than the reference quantity, the program proceeds to step S11.

Step S7: The print engine 12 prints the first one copy of the print job and then enters the standby state.

Step S8: The test printing notifying section 34 notifies the host apparatus 11 through the host I/F 21 that the test printing will be performed and that the printer 10 will enter a standby state.

Step S9: A check is made to determine whether the user's permission storing section 27 holds the print permission of remaining quantity of output. If the user's permission storing section 27 holds the print permission of remaining quantity of output, then the program proceeds to S11. If the user's permission storing section 27 does not holds the print permission of the remaining quantity of output, then the program proceeds to step S10.

Step S10: A check is made to determine whether the user's permission storing section 27 holds a "print cancel" of remaining quantity of output. If the user's permission storing section 27 holds the "print cancel" of remaining quantity of output, then the program ends. If the user's permission storing section 27 does not hold the "print cancel" of remaining quantity of output, then the program jumps back to step S9.

Step S11: The remaining quantity of output is printed and then the program ends.

In the first embodiment, when the total-quantity-of-output exceeds the reference quantity, it is determined that the test printing is required. After printing a fraction of image data, e.g., some pages of the print job or one copy of the print job, the remaining quantity of output is not printed until the user's permission is obtained. Thus, test printing for one copy of each print job can be performed without setting test printing on a job-to-job basis, thereby preventing a plurality of copies of poor quality as well as optimizing the utilization of consumable items such as print medium.

Second Embodiment

{Configuration}

Figure 3:
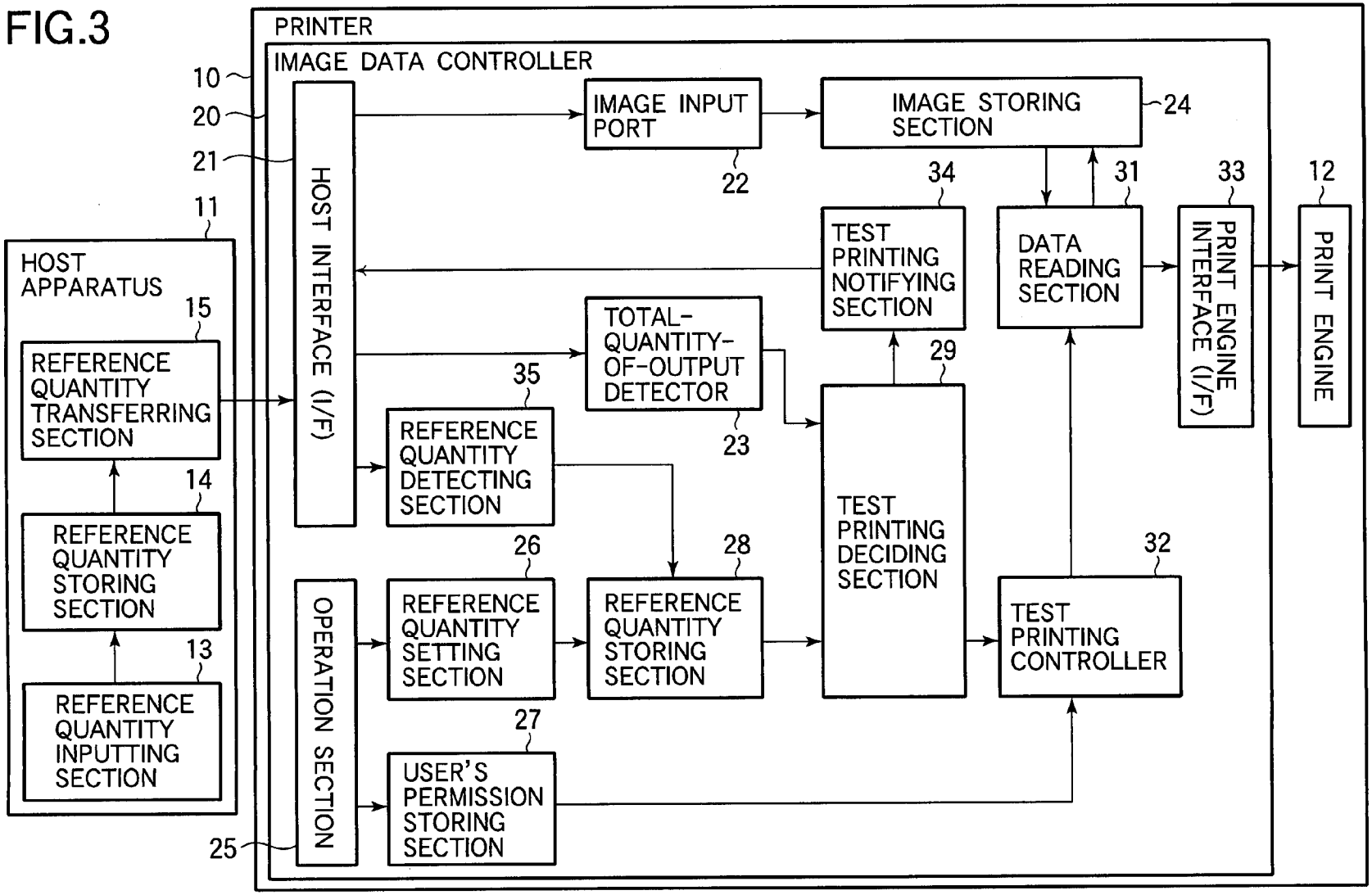
FIG. 3 is a block diagram illustrating the configuration of a printer according to a second embodiment.

FIG. 3 is a block diagram illustrating the configuration of a printer according to a second embodiment. Elements similar to those in the first embodiment have been given the same numerals and their description is omitted.

As shown in FIG. 3, a user inputs a reference quantity into a reference quantity inputting section 13 in a host apparatus 11. A reference quantity storing section 14 stores the reference quantity inputted through the reference quantity inputting section 13. A reference quantity transferring section 15 transfers the reference quantity received from the reference quantity storing section 14 to a printer 10. An image data controller 20 is provided with a reference quantity detecting section 35 detects, and receives the reference quantity sent from the host apparatus 11.

When the user inputs the reference quantity into the reference quantity inputting section 13, the reference quantity is stored into the reference quantity storing section 14. Then, the reference quantity transferring section 15 reads the reference quantity from the reference quantity storing section 14, and transfers the reference quantity to the reference quantity detecting section 35 through the host interface 21. Upon detecting the reference quantity received from the host apparatus 11, the reference quantity detecting section 35 stores the reference quantity into a reference quantity storing section 28. The rest of the configuration is the same as the first embodiment and their description is omitted.

{Setting of Reference Quantity}

Figure 4:
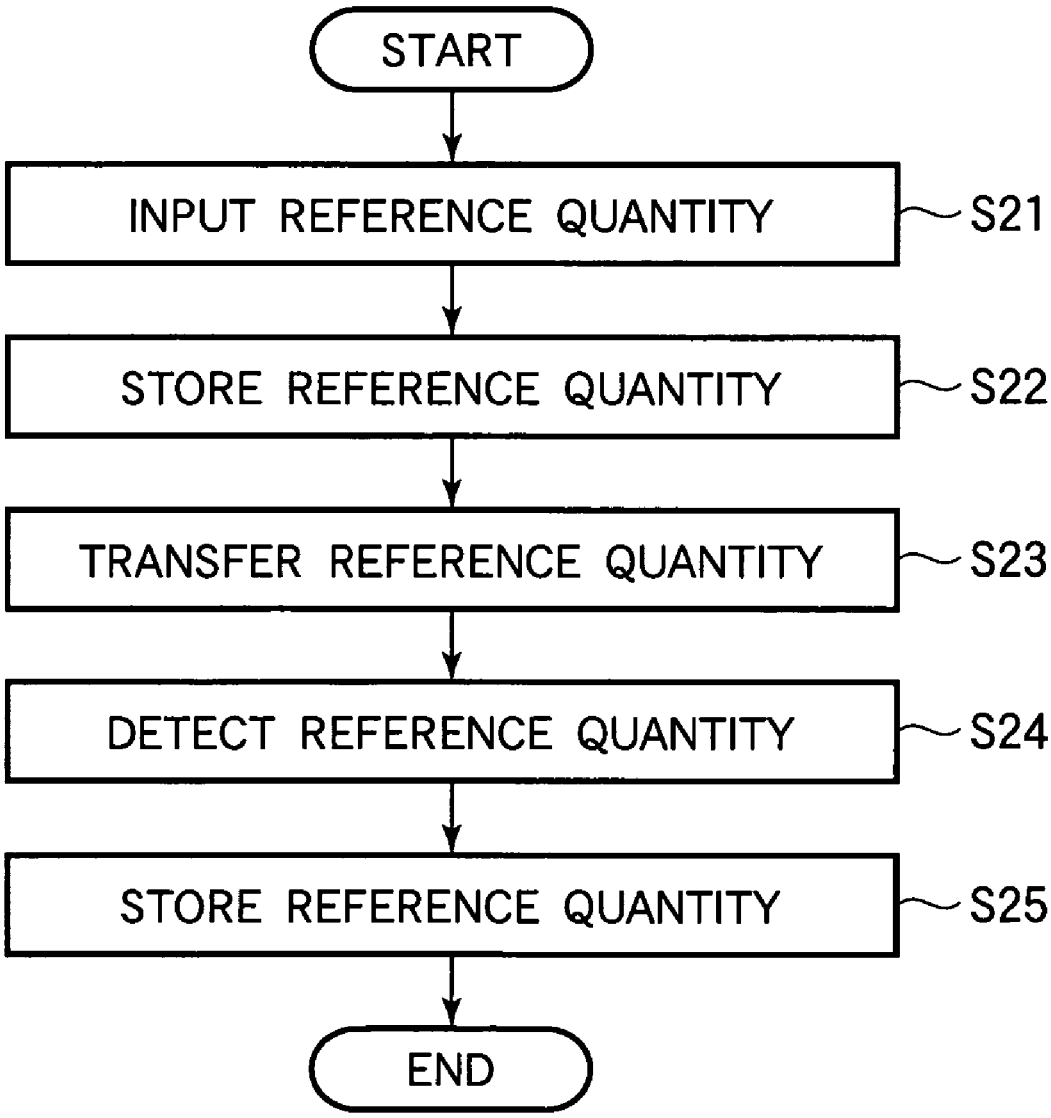
FIG. 4 is a flowchart illustrating the operation in which the reference quantity is set.

FIG. 4 is a flowchart illustrating the operation in which the reference quantity is set. The operation in which the reference quantity is set will be described.

The user inputs the reference quantity via the reference quantity inputting section 13 of the host apparatus 11. Then, the reference quantity storing section 14 stores the reference quantity. Subsequently, the reference quantity transferring section 15 reads the reference quantity from the reference quantity storing section 14, and transfers the reference quantity to the printer upon request. The reference quantity is directed through the host interface 21 to the reference quantity detecting section 35.

The reference quantity detecting section 35 detects the reference quantity, and stores the reference quantity into the reference quantity storing section 28. This completes the operation.

The printing operation is the same as that of the first embodiment. The following is a brief description of the flowchart in FIG. 4.

Step S21: The user inputs the reference quantity into the reference quantity inputting section 13 of the host apparatus 11.

Step S22: The reference quantity storing section 14 stores the reference quantity therein.

Step S23: The reference quantity transferring section 15 transfers the reference quantity to the printer 10.

Step S24: The reference quantity detecting section 35 detects the reference quantity.

Step S25: The reference quantity detecting section 35 stores the reference quantity into the reference quantity storing section 28, and then completes the operation.

As described above, in the second embodiment, the host apparatus 11 is provided with the reference quantity inputting section 13, reference quantity storing section 14, reference quantity transferring section 15, and the printer 10 provided with the reference quantity detecting section 35, which facilitate the setting of reference quantity.

While the second embodiment has been described with respect to the printer 10, the invention may be applied to a multi function printer (MFP), a facsimile machine, and a copying machine as well as a printing system that includes a host apparatus and a printer server.

Third Embodiment

{Configuration}

Figure 5:
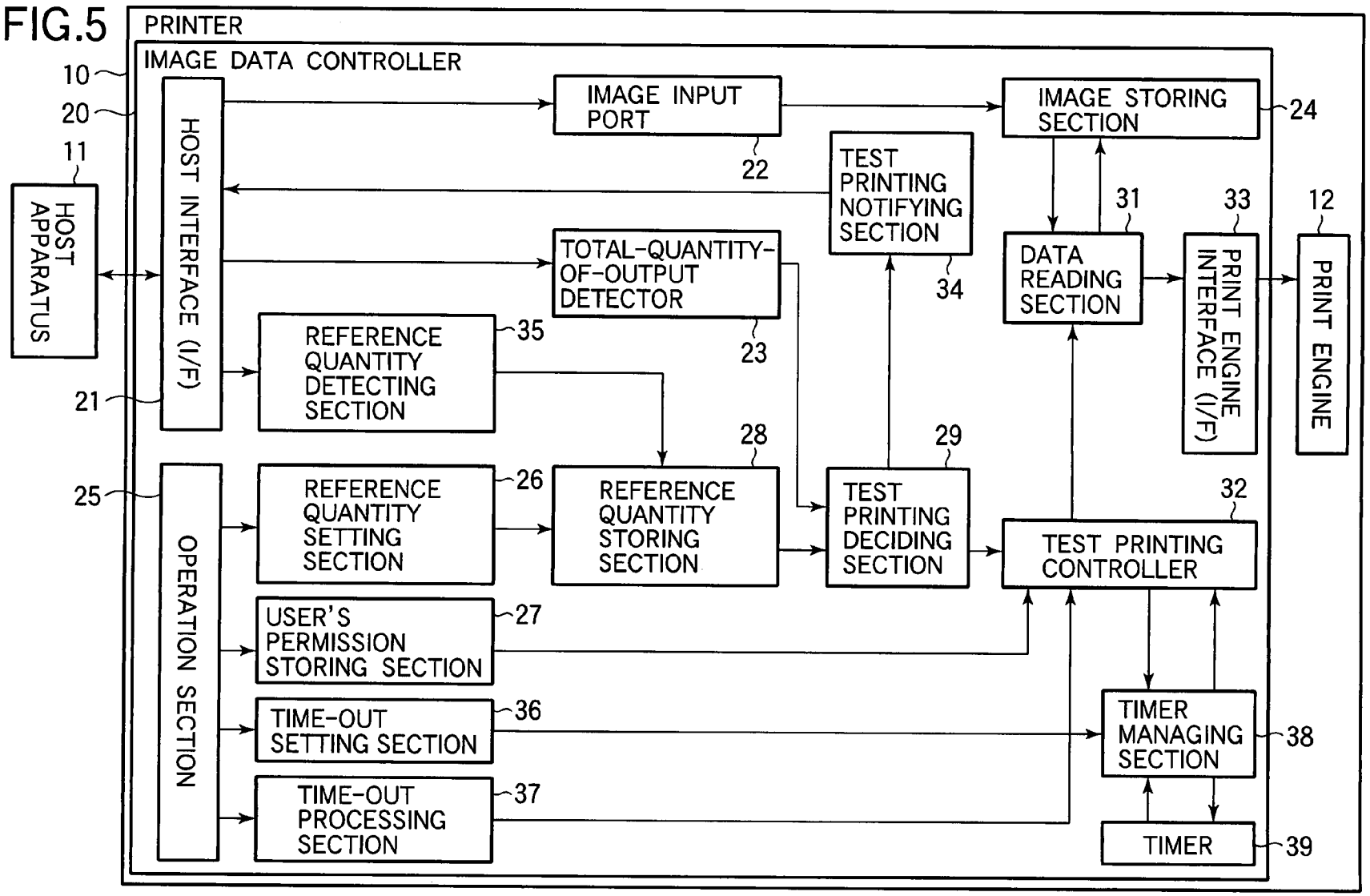
FIG. 5 is a block diagram illustrating the configuration of a printer according to a third embodiment.

FIG. 5 is a block diagram illustrating the configuration of a printer 10 according to a third embodiment. Elements similar to those in the first and second embodiments have been given the same reference numerals and their description is omitted.

Referring to FIG. 5, an image data controller 20 according to the third embodiment includes a time-out setting section 36, a time-out processing section 37, a timer 39, and a timer managing section 38. The time-out setting section 36 sets a reference value used for determining a "time-out condition". The time-out processing section 37 sets a user command to print remaining quantity of output when the time-out condition occurs. The timer managing section 38 controls the timer 39.

In the third embodiment, the user operates an operation section 25 to input a predetermined time length for which the printer 10 has to stay in a standby state after printing one copy of a printing job. This predetermined time length is stored into the time-out setting section 36. The user also operates the operation section 25 to input a user's command for processing the remaining quantity of output. This user's command specifies either to print the remaining quantity of output of the image data stored in an image storing section 24 or to erase the image data from the image storing section 24, and is stored into the time-out processing section 37.

When a test printing controller 32 notifies the timer managing section 38 that the printer 10 is in the standby state after printing one copy of a print job, the timer managing section 38 activates the timer 39. When the count of the timer 39 exceeds the predetermined time-length, the timer managing section 38 notifies the test printing controller 32 that the time is out. In response to the notification from the timer managing section 38, the test printing controller 32 processes the remaining quantity of output of a print job in a manner stored in the time-out processing section 37.

{Operation for Setting Reference Quantity}

Figure 6:
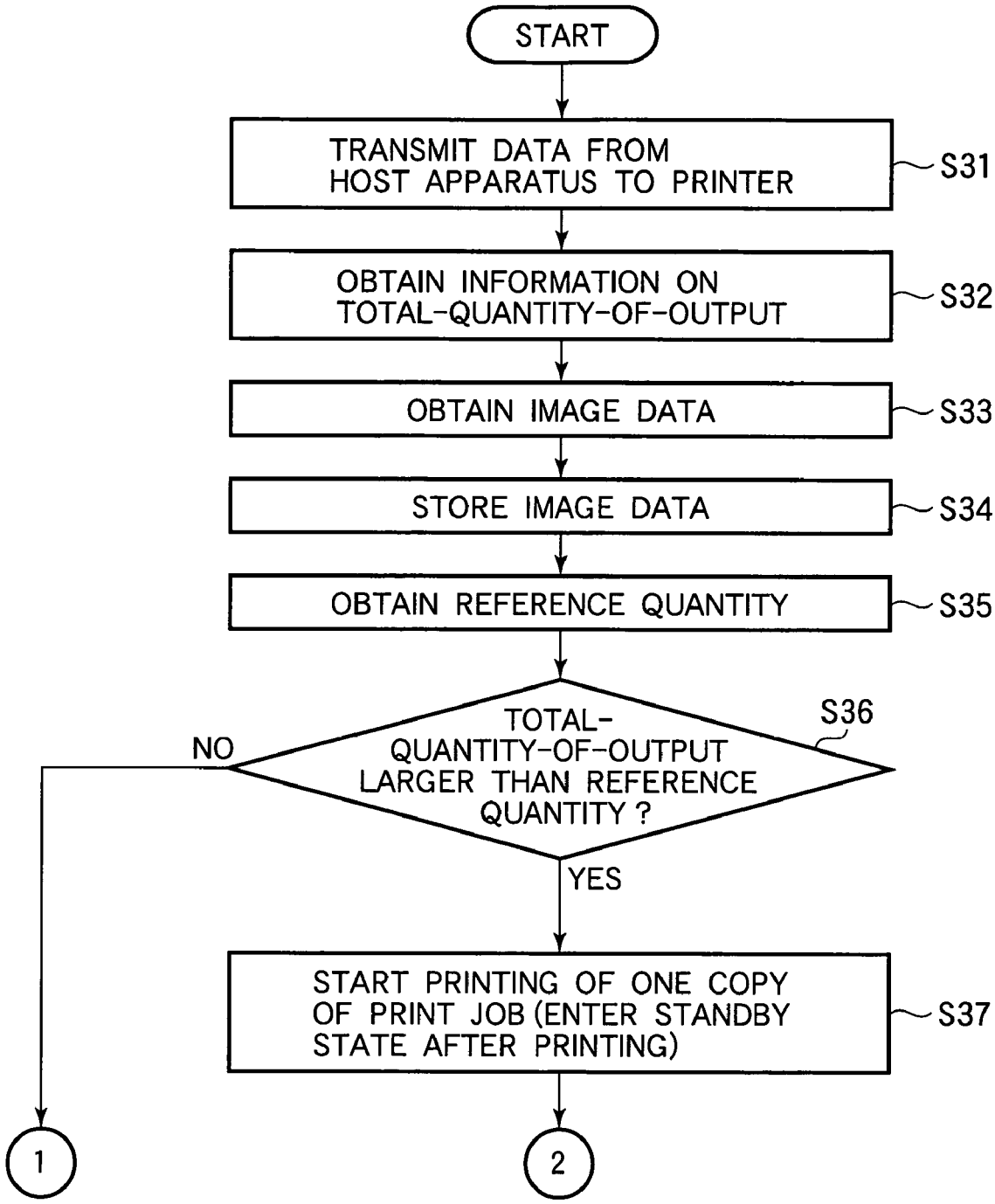
FIG. 6 is a first portion of a flowchart.
Figure 7:
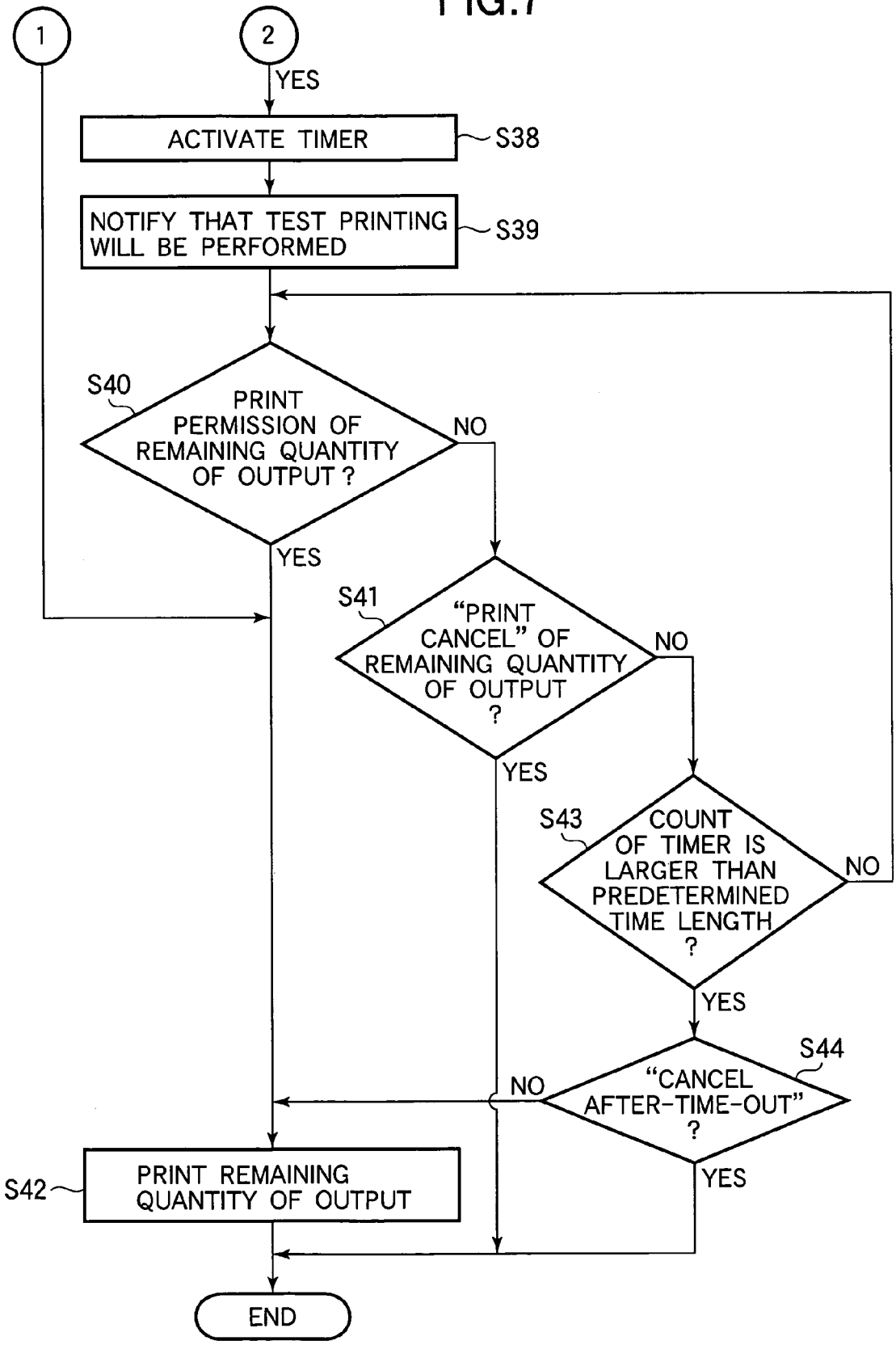
FIG. 7 is a second portion of the flowchart.

FIGS. 6 and 7 illustrate the operation of the printer 10 during printing, FIG. 6 being a first portion of a flowchart and FIG. 7 being a second portion of the flowchart. The operation for setting the reference quantity will be described with reference to FIGS. 6 and 7.

The operation of the third embodiment from the data transmission from a host apparatus 11 until the printer 10 enters a standby state after printing one copy of a print job is the same as that of the first embodiment.

Subsequently, when the test printing-controller 32 notifies the timer managing section 38 that test printing should be performed, the timer managing section 38 activates the timer 39. When a test printing notifying section 34 receives a result outputted from a test printing deciding section 29, the test printing notifying section 34 notifies the host apparatus 11 through the host interface 21 that the test printing will be performed and the printer 10 will enter a standby state.

After printing first one copy of a print job, a user's permission storing section 27 obtains user's permission from the operation section 25. The test printing controller 32 determines whether the remaining quantity of output of the print job is ready to be printed. In other words, the test printing controller 32 determines whether the user's permission storing section 27 holds print permission of the remaining quantity of output (i.e., a user's permission to print user's permission. If the user's permission storing section 27 holds print permission, the test printing controller 32 determines that the remaining quantity of output of the print job is allowed to be printed, and then controls a data reading section 31 to print the remaining quantity of output of the print job. In response to the command from the test printing controller 32, the data reading section 31 reads the image data for the remaining quantity of output from the image storing section 24, and then outputs the data to the print engine 12 via the print engine interface 33. This completes the operation.

If the user's permission storing section 27 does not hold the print permission for the remaining quantity of output, the test printing controller 32 determines that the print permission for the remaining quantity of output is not available, and checks whether the user's permission storing section 27 holds "print cancel" for the remaining quantity of output. If the user's permission storing section 27 holds the "print cancel" for the remaining quantity of output, the test printing controller 32 cancels the printing of the remaining quantity of output of the print job.

If the user's permission storing section 27 does not hold the "print cancel" for the remaining quantity of output, a check is made to determine whether the count of the timer 39 has exceeded the predetermined time-length. In other words, the timer managing section 38 reads the count from the timer 39 and the predetermined time length from the time-out setting section 36, and then compares these two values. If the count of the timer 39 has not exceeded the predetermined time-length, the test printing controller 32 checks whether the user's permission storing section 27 holds print permission for the remaining quantity of output.

If the count of the timer 39 has exceeded the predetermined time-length, the test printing controller 32 reads the value of the time-out processing section 37 to determine whether the time-out processing section 37 holds "cancel after-time-out". If the time-out processing section 37 holds "cancel after-time-out," the test printing controller 32 clears the data reading section 31 and cancels the printing of the remaining quantity of output of the print job, completing the operation. If the time-out processing section 37 does not hold "cancel after-time-out," the test printing controller 32 controls the data reading section 31 to print the printing of the remaining quantity of output of the print job. Thus, under the control of the test printing controller 32, the data reading section 31 reads the image data for the remaining quantity of output from the image storing section 24, and outputs the image data to the print engine 12 through the print engine interface 33 for printing the remaining quantity of output. This completes the operation.

The following is a brief description of the flowchart in FIGS. 6 and 7.

Step S31: The host apparatus 11 transmits the data to the printer 10.

Step S32: A total-quantity-of-output detector 23 obtains the information on the total-quantity-of-output.

Step S33: The image input port 22 obtains the image data.

Step S34: The image storing section 24 stores the image data.

Step S35: The test printing deciding section 29 obtains the reference quantity from the reference quantity storing section 28.

Step S36: The test printing deciding sect 29 determines whether the total-quantity-of-output is larger than the reference quantity. If the answer is YES, then the program proceeds to step S37. If the answer is NO, the program proceeds to step S42.

Step S37: The first one copy of the print job is printed, and then the program enters the standby state.

Step S38: The timer managing section 38 activates the timer 39.

Step S39: The test printing notifying section 34 notifies the host apparatus 11 that test printing will be performed and the printer 10 will enter a standby state.

Step S40: A check is made to determine whether the user's permission storing section 27 holds the print permission of the remaining quantity of output. If the answer is YES, then the program proceeds to S42. If the answer is NO, then the program proceeds to S41.

Step S41: A check is made to determine whether the user's permission storing section 27 holds the "print cancel" of the remaining quantity of output. If the answer is YES, then the program ends. If the answer is NO, then the program proceeds to step S43.

Step S42: The remaining quantity of output is printed and then the program ends.

Step S43: A check is made to determine whether the count of the timer 39 is larger than the predetermined time length. If the answer is YES, then the program proceeds to step S44. If the answer is NO, then the program loops back to step S40.

Step S44: A check is made to determine whether the time-out processing section 37 holds "cancel after-time-out." If the answer is YES, then the program ends. If the answer is NO, then the program proceeds to step S42.

As described above, the image data controller 20 of the printer 10 includes the timer managing section 38, timer 39, time-out setting section 36, and time-out processing section 37. This configuration provides an advantage that the printer 10 places limitations on the time length for which one user exclusively uses the printer 10, thereby reducing the waiting time of other users.

Fourth Embodiment

{Configuration}

Figure 8:
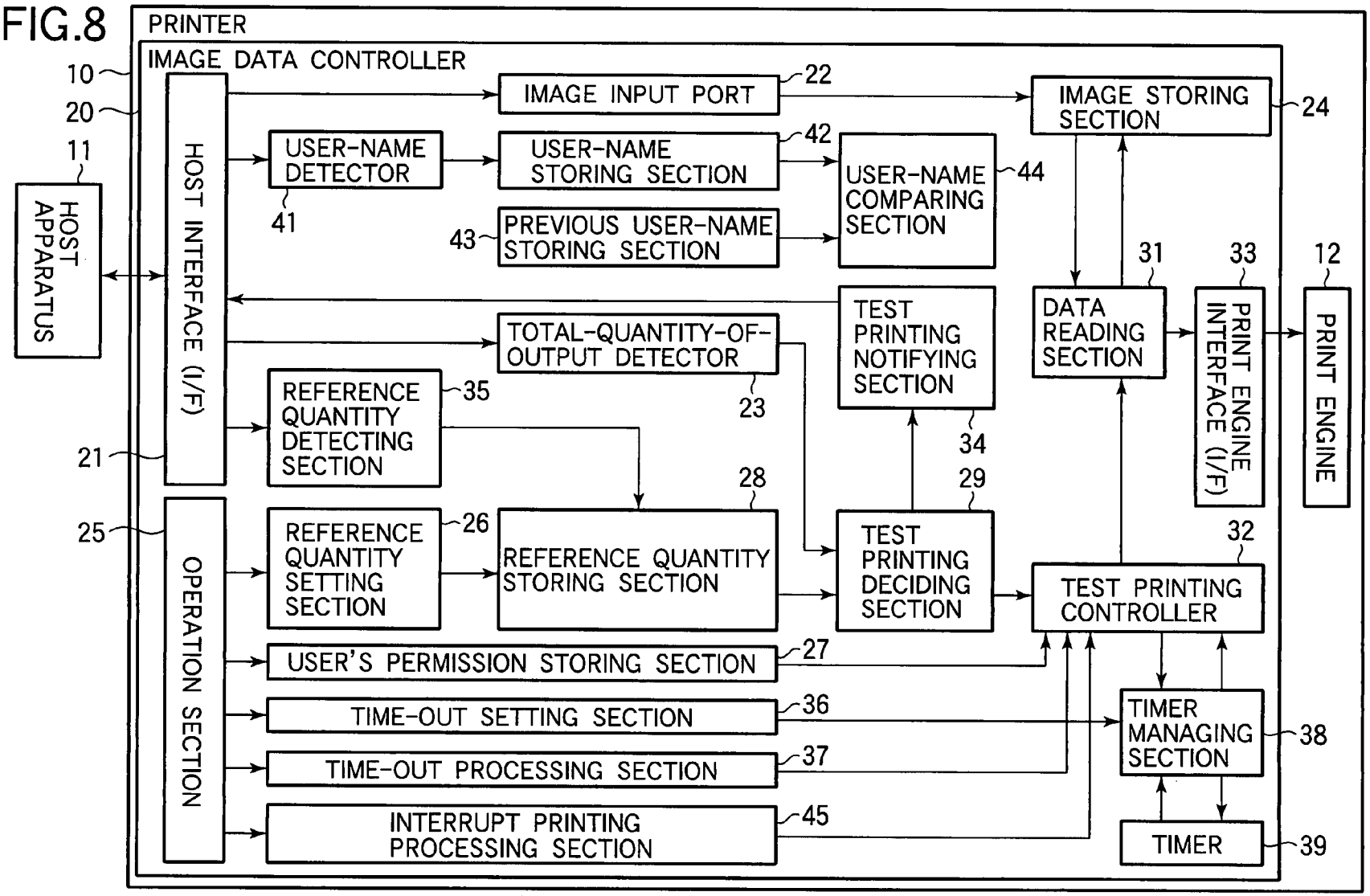
FIG. 8 is a block diagram illustrating the configuration of a printer according to a fourth embodiment.

FIG. 8 is a block diagram illustrating the configuration of a printer 10 according to a fourth embodiment. Elements similar to those in the first to third embodiments have been given the same reference numerals and their description is omitted.

As shown in FIG. 8, an image data controller 20 in the printer 10 includes a user-name detector 41, user-name storing section 42, previous user-name storing section 43, user-name comparing section 44, and interrupt printing processing section 45. The user-name detector 41 detects a sender that sent i.e., obtains information on sender. The user-name storing section 42 serves as a memory means that stores the detected user name. The previous user-name storing section 43 stores a previously processed user name from the user-name storing section 42. The user-name comparing section 44 compares the user names. The interrupt printing processing section 45 initiates the interrupt printing process upon a print request from other user via the operation section 25 when the printer 10 is in a standby state waiting for the previous user's request for printing the remaining quantity of output of a print job.

Figure 9:
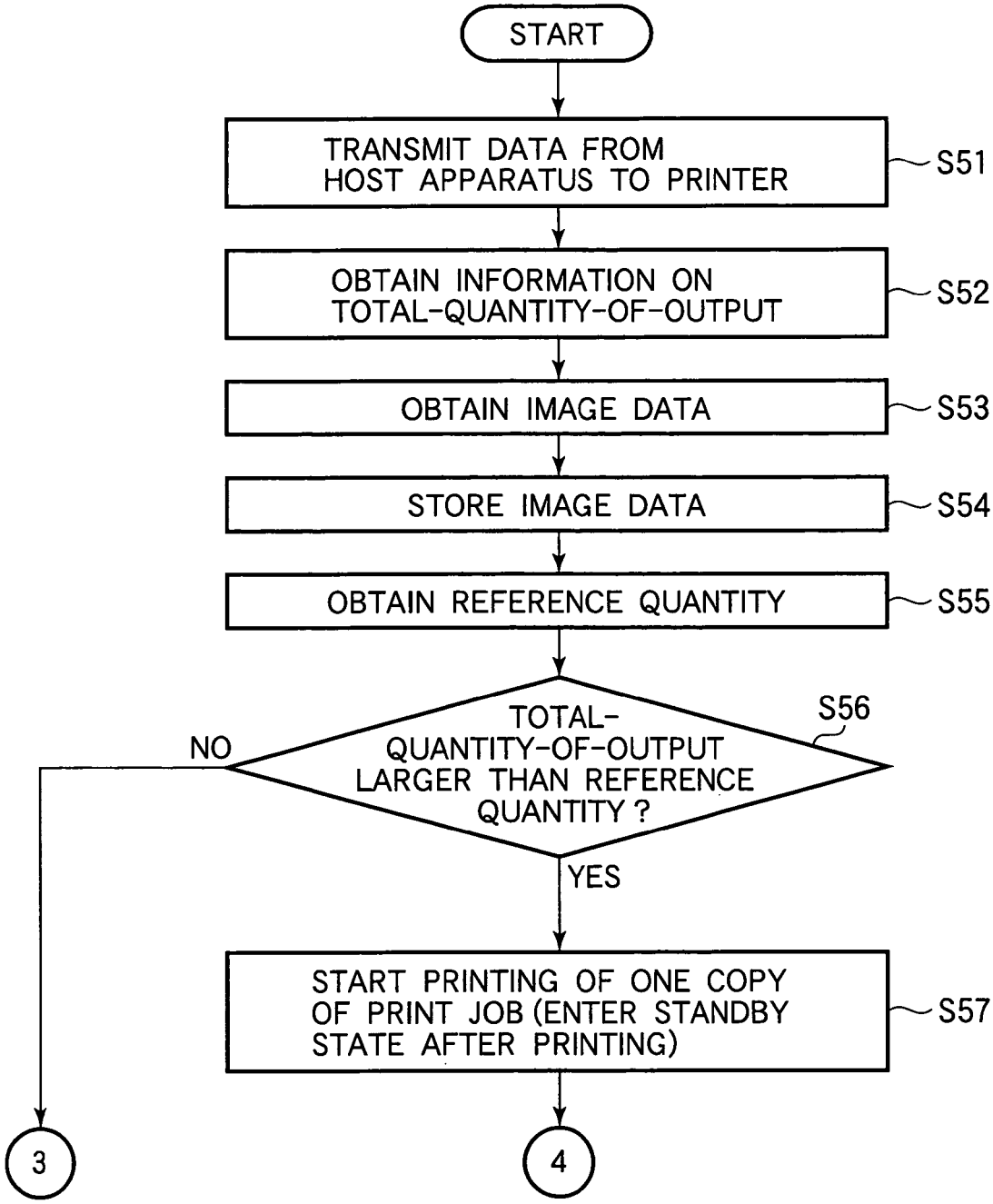
FIG. 9 is a first flowchart illustrating the operation of the printer when printing is being performed.
Figure 10:
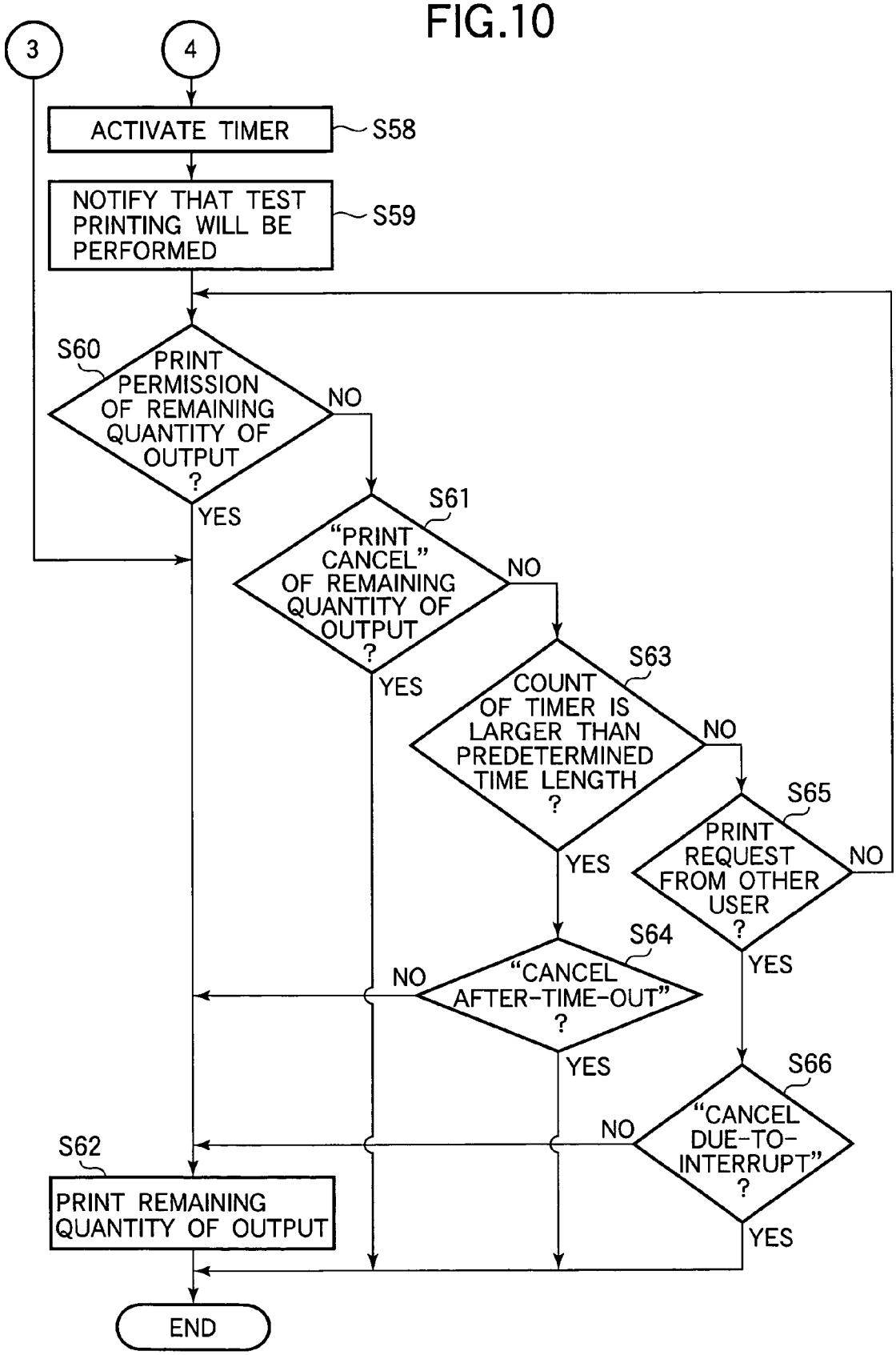
FIG. 10 is a second flowchart illustrating the operation of the printer when printing is being performed.

FIG. 9 is a first flowchart illustrating the operation of the printer 10 when printing is being performed. FIG. 10 is a second flowchart illustrating the operation of the printer 10 when printing is being performed.

The operation from when data is transmitted from a host apparatus 11 until a check is made to determine whether the count of a timer 39 has exceeded a predetermined time length is the same as that in the third embodiment and the description is omitted. The operation when the count of the timer 39 has exceeded the predetermined time length is also the same as that of the third embodiment, and the description is omitted.

If the count of the timer 39 has not exceeded the predetermined time length, a check is made to determine whether other users have outputted a print request. When the printer 10 is in the standby state, if print data is transmitted from the host apparatus 11, the user-name detector 41 detects the user information which in turn is stored into the user-name storing section 42. The previous user name in the user-name storing section 42 is transferred into the previous user name storing section 43. The user-name comparing section 44 compares the user name in the user-name storing section 42 with the previous user name in the previous user-name storing section 43. If these user names are coincident, then it is determined that no print request from other users has occurred, and a check is made to determine whether a user's permission storing section 27 holds print permission for the remaining quantity of output of a print job. If the user names are not coincident, then it is determined that the print request is not issued by the previous user (i.e., the print request is from other user), and the user-name comparing section 44 notifies a test printing controller 32.

When the test printing controller 32 receives a notification from the user-name comparing section 44 that the print request is issued by the previous user, the test printing controller 32 reads the information previously stored in the interrupt printing processing section 45, thereby checking the information to determine whether the interrupt printing processing section 45 holds "cancel due-to-interrupt." If the interrupt printing processing section 45 holds "cancel due-to-interrupt," the test printing controller 32 clears the data reading section 31, so that the printing of the remaining quantity of output of a print job is cancelled. This completes the operation.

If the interrupt printing processing section 45 does not hold "cancel due-to-interrupt," the test printing controller 32 controls the data reading section 31 such that the printing of the remaining quantity of output of a print job is performed. Then, the data reading section 31 reads the image data from the image storing section 24 and outputs the image data to the print engine 12 through the print engine interface 33 so that the remaining quantity of output is printed. This completes the operation.

The following is a brief description of the flowchart.

Step S51: The host apparatus 11 transmits the data to the printer 10.

Step S52: A total-quantity-of-output detector 23 obtains the information on the total-quantity-of-output.

Step S53: The image input port 22 obtains the image data.

Step S54: The image storing section 24 stores the image data.

Step S55: The test printing deciding section 29 obtains the reference quantity from the reference quantity storing section 28.

Step S56: The test printing deciding section 29 determines whether the total-quantity-of-output is larger than the reference quantity. If the answer is YES, the program proceeds to step S57. If the answer is NO, the program proceeds to step S62.

Step S57: The print engine 12 prints the first one copy of the print job and then enters the standby state.

Step S58: A timer managing section 38 activates the timer 39.

Step S59: A test printing notifying section 34 notifies the host apparatus 11 that test printing will be performed.

Step S60: A check is made to determine whether the print permission of the remaining quantity of output is held in the user's permission storing section 27. If the answer is YES, then the program proceeds to S62. If the answer is NO, then the program proceeds to S61.

Step S61: A check is made to determine whether the user's permission storing section 27 holds the "print cancel" of the remaining quantity of output. If the answer is YES, then the program ends. If the answer is NO, then the program proceeds to step S63.

Step S62: The print engine prints the remaining quantity of output of the print job and then the program ends.

Step S63: A check is made to determine whether the count of the timer 39 is larger than the predetermined time length. If the answer is YES, then the program proceeds to step S64. If the answer is NO, then the program loops back to step S65.

Step S64: A check is made to determine whether a time-out processing section 37 holds "cancel after-time-out." If the answer is YES, the program ends. If the answer is NO, the program proceeds to step S62.

Step S65: A check is made to determine whether a print request from other user exists. If the answer is YES, then the program proceeds to step S66. If the answer is NO, the program proceeds to step S60.

Step S66: A check is made to determine whether the interrupt printing processing section 45 holds "cancel due-to-interrupt." If the answer is YES, the program ends. If the answer is NO, the program proceeds to step S62.

The image data controller 20 of the printer 10 includes the user-name detector 41, user-name storing section 42, previous user-name storing section 43, and user-name comparing section 44. This configuration allows the printer 10 to address the print request from other users when the printer 10 is in the standby state after printing the first one copy in the test printing. The configuration improves the overall throughput of the printer 10.

Fifth Embodiment

{Configuration}

Figure 11:
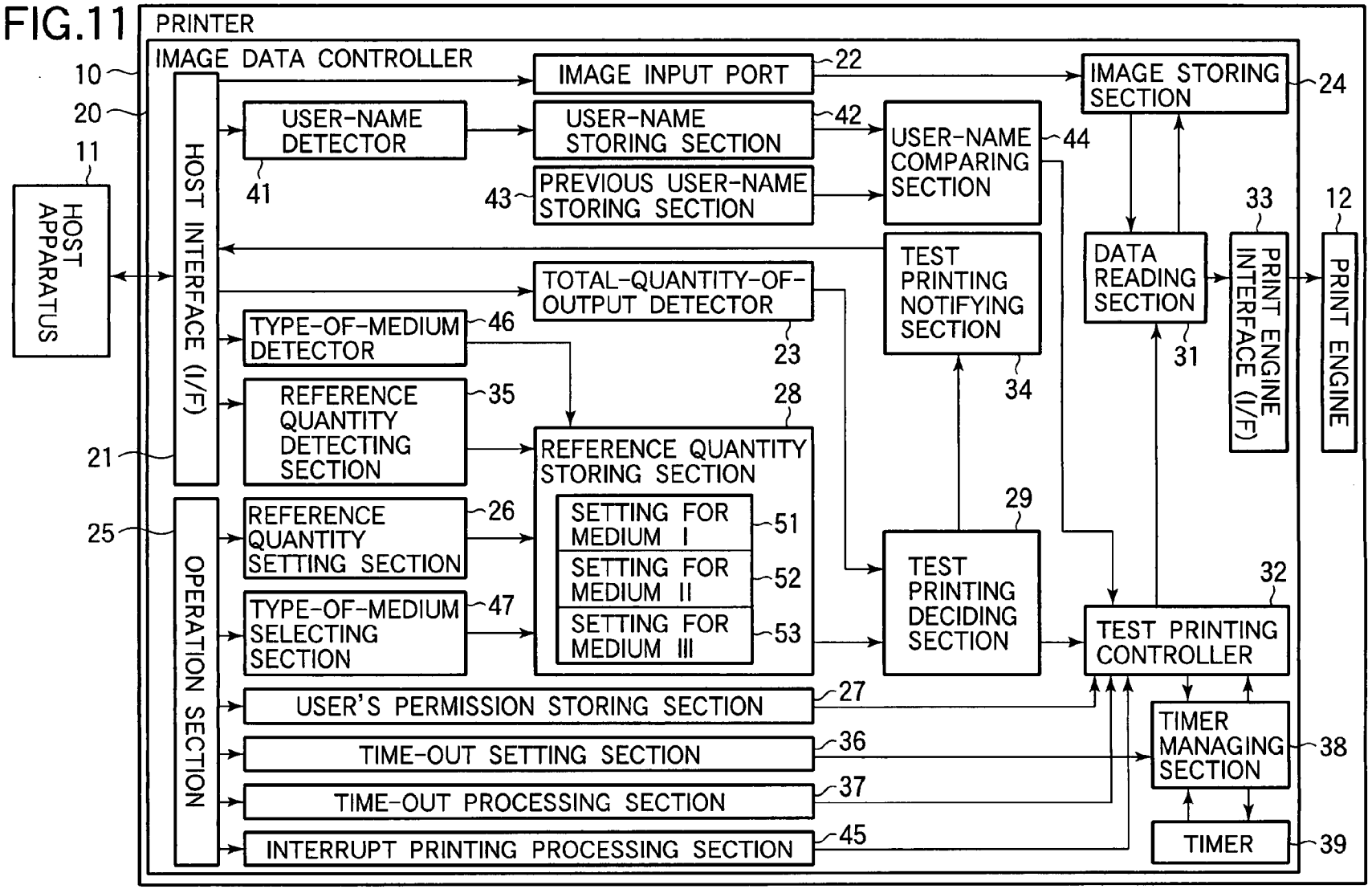
FIG. 11 is a block diagram illustrating the configuration of a printer according to a fifth embodiment.

FIG. 11 is a block diagram illustrating the configuration of a printer 10 according to a fifth embodiment. Elements similar to those in the first to fourth embodiments have been given the same reference numerals and their description is omitted.

As shown in FIG. 11, an image data controller 20 of a printer 10 includes a type-of-medium detector 46 and a type-of-medium selecting section 47. The type-of-medium detector 46 detects the type of medium used in printing image data. The type-of-medium selecting section 47 selects the type of medium in order to set the reference quantity for each type of medium through an operation section 25. Reference quantity is a maximum allowable quantity of print medium (e.g., OHP, ordinary paper, and thick paper) that is consumed in a single printing operation. A reference quantity storing section 28 stores reference quantities for different types of medium, and includes a setting 51 for medium I, a setting 52 for medium II, and a setting 53 for medium III.

Upon detecting the type of medium, the type-of-medium detector 46 notifies the reference quantity storing section 28 of the type of medium. The reference quantity storing section 28 selects a reference quantity suitable for a corresponding type of medium from among the medium setting 51, medium setting 52, and medium setting 53, and notifies a test printing deciding section 29 of the selected reference quantity.

{Operation}

Figure 12:
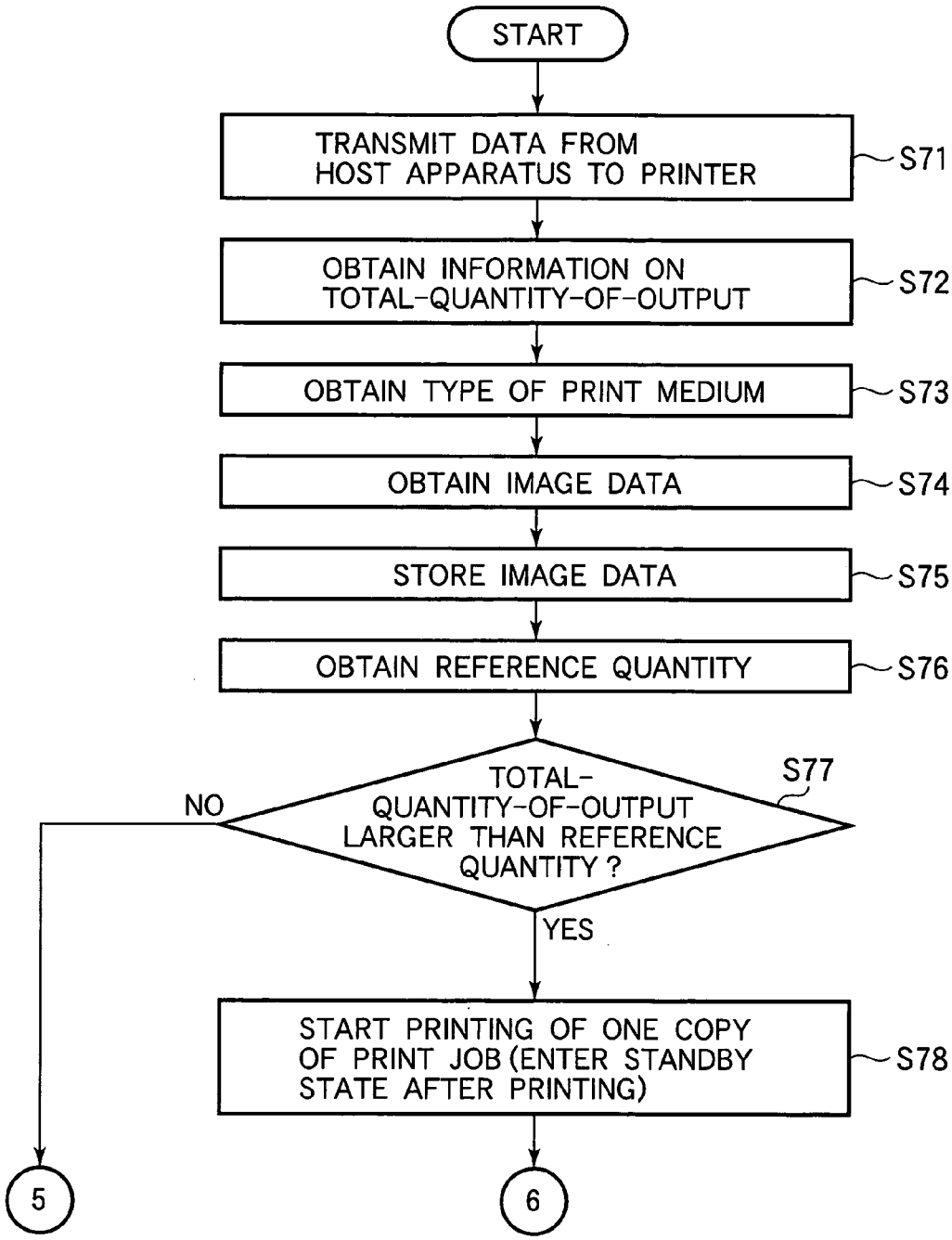
FIG. 12 is a first flowchart illustrating the operation of the printer when printing is being performed.
Figure 13:
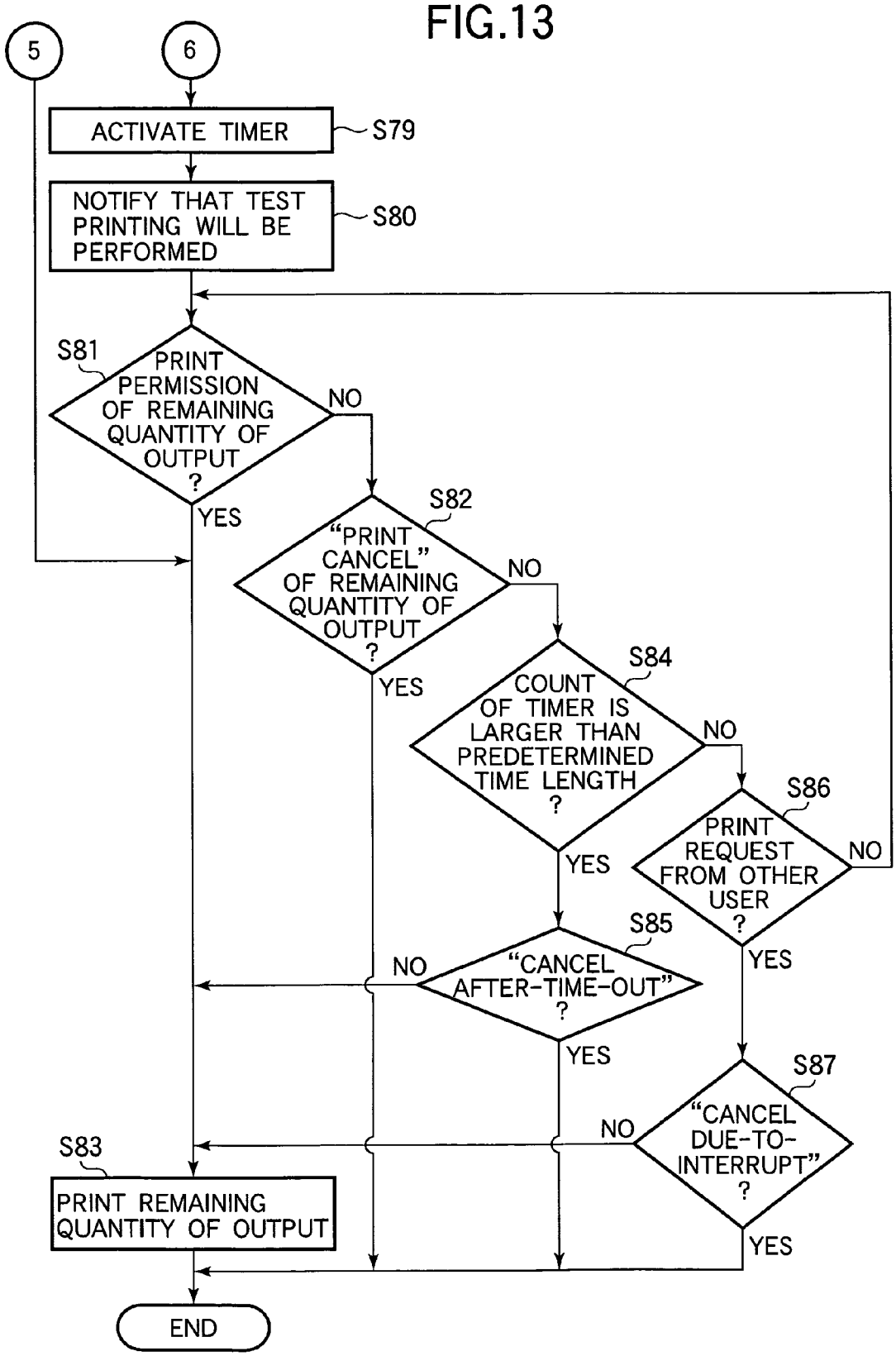
FIG. 13 is a second flowchart illustrating the operation of the printer when printing is being performed.

FIG. 12 is a first flowchart illustrating the operation of the printer 10 when printing is being performed. FIG. 13 is a second flowchart illustrating the operation of the printer 10 when the printing is being performed.

A host apparatus 11 transmits data to a printer 10. A total-quantity-of-output detector 23 detects information on the total-quantity-of-output from image information received from the host apparatus 11 through a host interface 21. The type-of-medium detector 46 obtains the corresponding type of medium through the host interface 21 from the image information received from the host apparatus 11, and then notifies the reference quantity storing section 28 of the type of medium. An image input port 22 obtains image data from the image information received from the host apparatus 11 through the host interface 21. An image storing section 24 receives the image data from the image input port 22, and stores it.

The reference quantity storing section 28 also stores the reference quantity. In other words, a user operates the operation section 25 in such a way that a reference quantity setting section 26 and the type-of-medium selecting section 47 cooperate to set reference quantities for the types of respective media. The reference quantities are stored separately for the respective types of the medium, i.e., a setting 51 for medium I, a setting 52 for medium II, and a setting 53 for medium III.

The remaining operation is the same as that of the fourth embodiment and the description of it is omitted.

The following is a brief description of the flowchart in FIG. 12.

Step S71: The host apparatus 11 transmits the data to the printer 10.

Step S72: The total-quantity-of-output detector 23 obtains the information on the total-quantity-of-output.

Step S73: The image input port 22 obtains the type of medium.

Step S74: The image input section 22 obtains the image data.

Step S75: The image storing section 24 stores the image data.

Step S76: The test printing deciding section 29 obtains the reference quantity from the reference quantity storing section 28.

Step S77: A check is made to determine whether the total-quantity-of-output is larger than the reference quantity. If the answer is YES, the program proceeds to step S78. If the answer is NO, the program proceeds to step S83.

Step S78: The print engine 12 starts printing the first one copy of the print job, and then enters the standby state after printing.

Step S79: The timer managing section 38 activates a timer 39.

Step S80: A test printing notifying section 34 notifies the host apparatus 11 that the test printing will be performed and the printer 10 will enter a standby state.

Step S81: A check is made to determine whether a user's permission storing section 27 holds print permission for the remaining quantity of output. If the answer is YES, then the program proceeds to step S82. If the answer is NO, then the program proceeds to step S82.

Step S82: A check is made to determine whether the user's permission storing section 27 holds the "print cancel" of the remaining quantity of output. If the answer is YES, the program ends. If the answer is NO, the program proceeds to step S84.

Step S83: The remaining quantity of output is printed and then the operation completes.

Step S84: A check is made to determine whether the output of the timer 39 is larger than a predetermined time length. If the answer is YES, the program proceeds to step S85. If the answer is NO, the program proceeds to step S86.

Step S85: A check is made to determine whether a time-out processing section 37 holds "cancel after-time-out." If the answer is YES, then the program ends. If the answer is NO, then the program proceeds to step S83.

Step S86: A check is made to determine whether a print request from other users has been received. If the answer is YES, then the program proceeds to step S87. If the print request from other users has not been received, the program returns to step S81.

Step S87: A check is made to determine whether the interrupt printing processing section 45 holds "cancel due-to-interrupt." If the answer is YES, the program ends. If the answer is NO, then the program proceeds to step S83.

According to the fifth embodiment, the image data controller 20 of the printer 10 includes the type-of-medium detector 46 that detects the type of medium and type-of-medium selecting section 47 that selects a reference quantity-in accordance with the type of medium. Further, the reference quantity storing section 28 includes the medium setting 51, medium setting 52, and medium setting 53. Thus, the reference quantity can be managed for each type of print medium. This provides more efficient utilization of consumable items such as print medium.

Sixth Embodiment

{Construction}

Elements similar to those in the first to fifth embodiments have been given the same reference numerals and their description is omitted.

Figure 14:
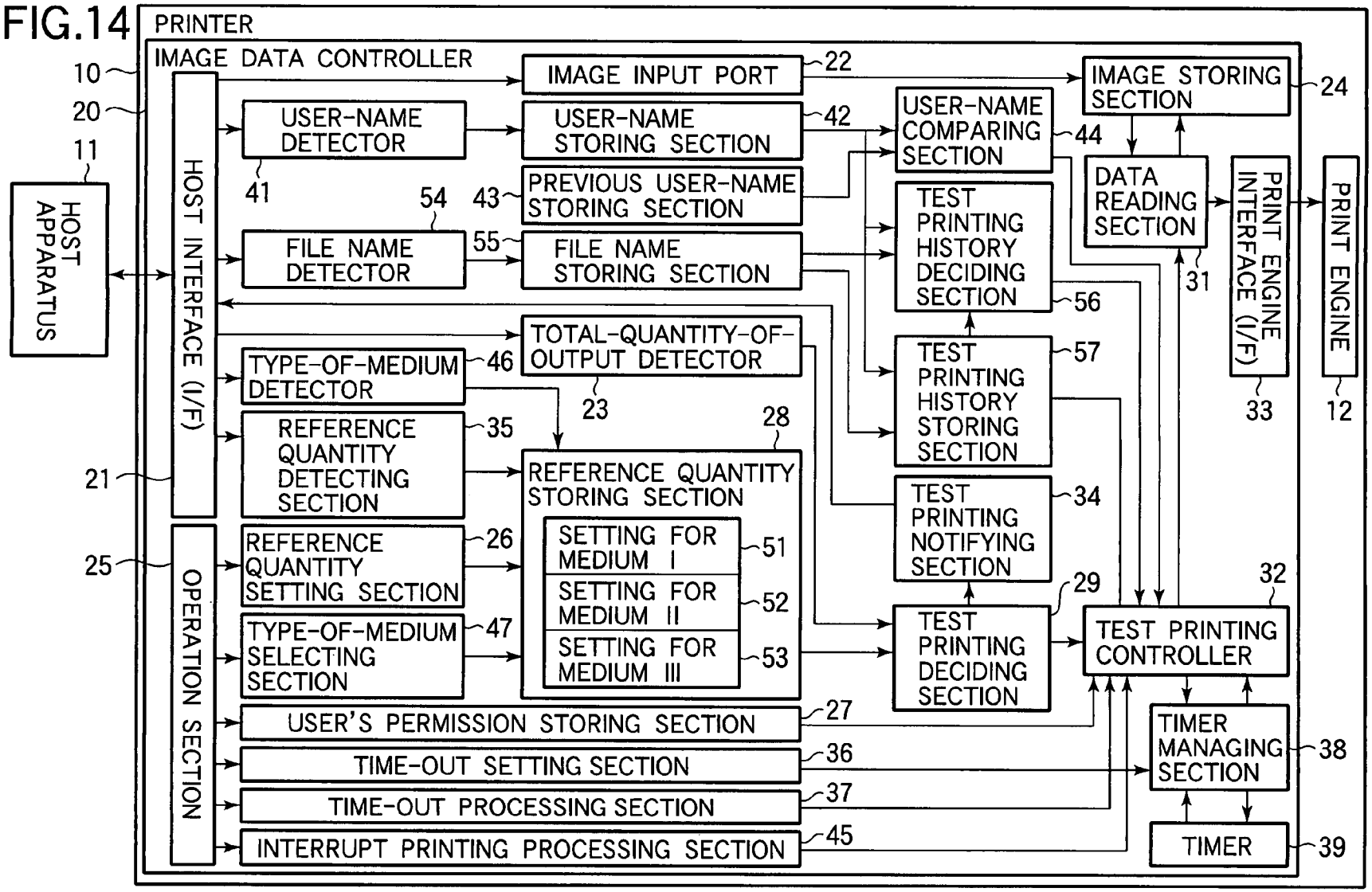
FIG. 14 is a block diagram illustrating the configuration of a printer according to a sixth embodiment.

FIG. 14 is a block diagram illustrating the configuration of a printer according to a sixth embodiment.

As shown in FIG. 14, the image data controller 20 of the printer 10 includes a file name detector 54, file name storing section 55, test printing history deciding section 56, and test printing history storing section 57. The file name detector 54 detects the file name of the data received from a host apparatus 11. The file name storing section 55 stores the detected filename. The test printing history deciding section 56 determines whether test printing was performed for the received data in the past. The test printing history storing section 57 stores information on the test printing performed in the past and logging information such as user names and file names. The test printing history deciding section 56 sends its determination to a test printing controller 32. If test printing was performed for the received data in the past, the test printing will not be performed for the received data.

{Operation}

Figure 15:
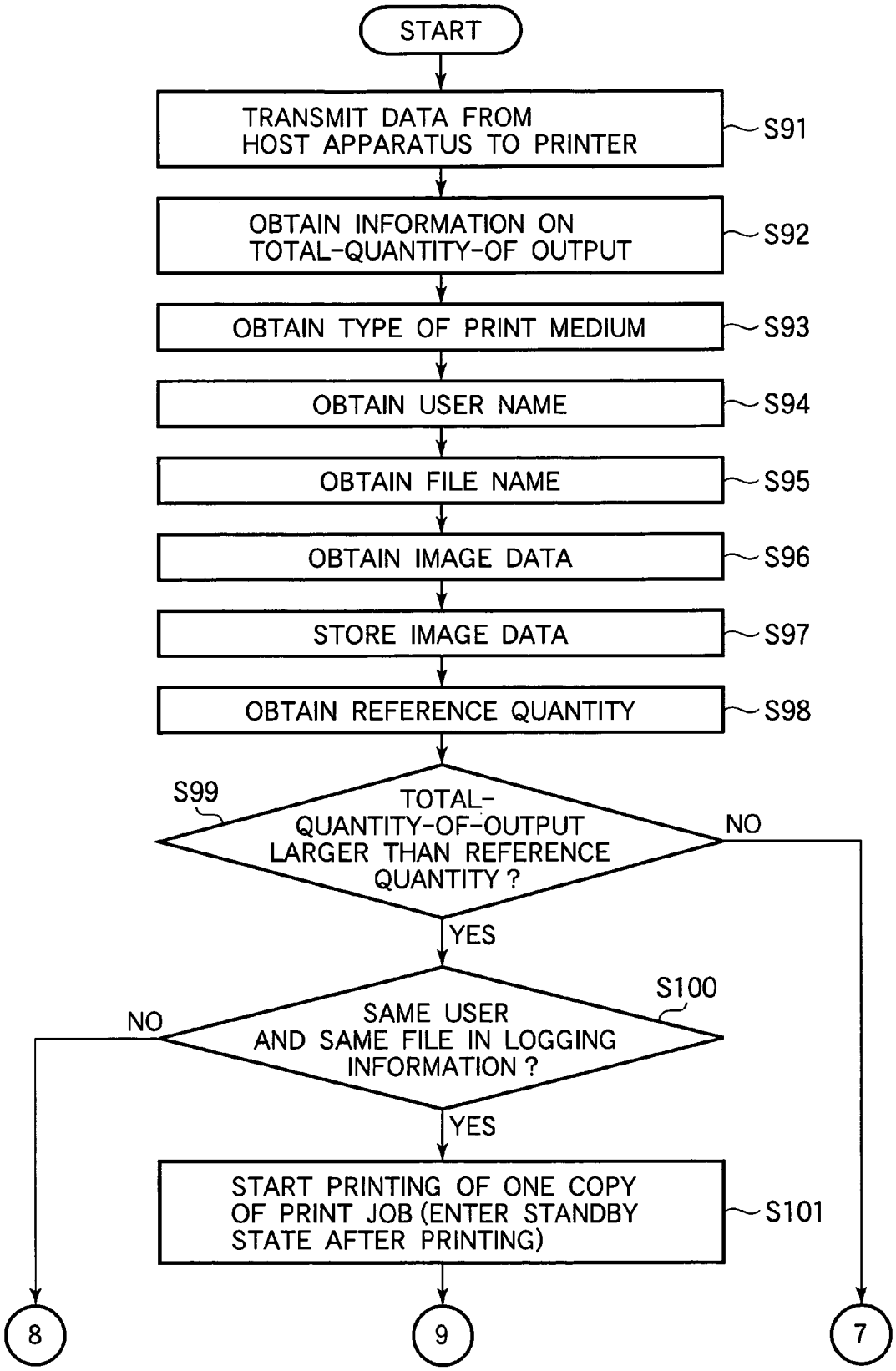
FIG. 15 is a first flowchart illustrating the operation of the printer when printing is being performed.
Figure 16:
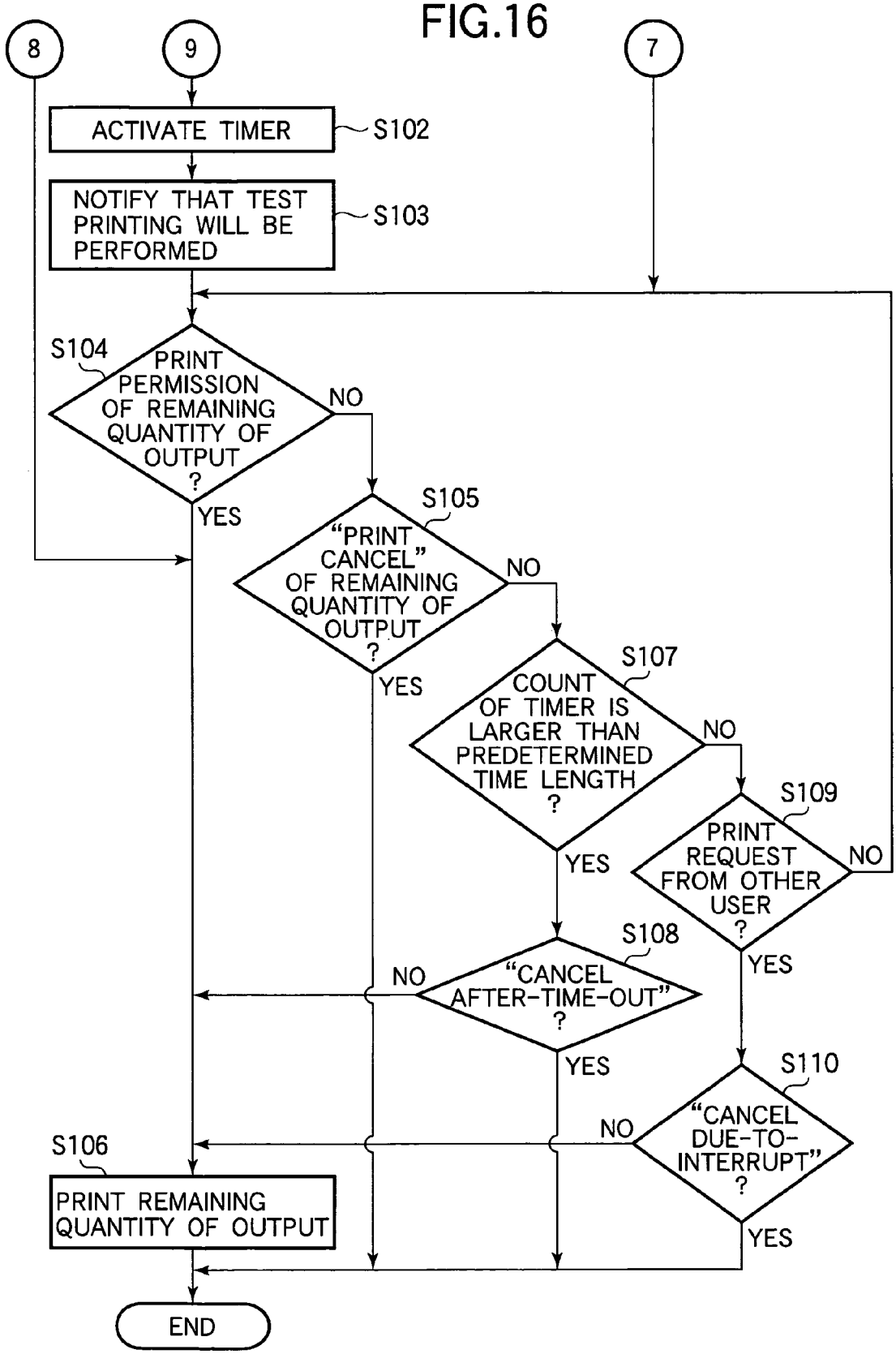
FIG. 16 is a second flowchart illustrating the operation of the printer when printing is being performed.

FIGS. 15 and 16 illustrate the operation of the printer when printing is being performed, FIG. 15 being a first flowchart and FIG. 16 being a second flowchart.

The operation of the printer 10 when printing is being performed will be described.

The host apparatus 11 transmits data to a printer 10. A total-quantity-of-output detector 23 obtains information on the total-quantity-of-output from image information received from the host apparatus 11 through a host interface 21. A type-of-medium detector 46 obtains the type of medium through the host interface 21 from the image information received from the host apparatus 11, and then notifies a reference quantity storing section 28 of the type of medium.

Subsequently, a user-name detector 41 obtains the user name from the image information received from the host apparatus 11 through the host interface 21, and stores the user name into a user name storing section 42. The file name detector 54 obtains the file name from the image information received from the host apparatus 11 through the host interface 21, and stores the file name into the file-name storing section 56.

The image input port 22 obtains image data from the image information received from the host apparatus 11 through the host interface 21. The image storing section 24 stores the image data obtained by the image input port 22. Further, the reference quantity storing section 28 obtains a reference quantity, and stores it. In other words, a user operates a operation section 25 in such a way that a reference quantity storing section 26 and a type-of-medium selecting section 47 cooperate to set the types of respective media. The reference quantities are stored into the medium setting 51, medium setting 52, and medium setting 53 depending on the type of the medium.

Subsequently, a test printing deciding section 29 compares the total-quantity-of-output obtained by the total-quantity-of-output detector 23 with the reference quantity stored in the reference quantity storing section 28 to determine whether the total-quantity-of-output is larger than the reference quantity. If the total-quantity-of-output is not larger than the reference quantity, a test printing controller 32 makes a decision to determine whether printing of the remaining quantity of output of a print job is allowed to be printed. If the total-quantity-of-output is larger than the reference quantity, the test printing history storing section 57 notifies the test printing history deciding section 56 of the test printing history.

The test printing history deciding section 56 reads current user-name information from the user name storing section 42 and the file name information from the file name storing section 55, and then checks the current user name information and file name information to determine whether test printing was performed in the past. In other words, the logging information is checked for the same user and the same file. If the same user and the same file are not found in the logging information, the test printing history deciding section 56 prompts the test printing controller 32 to perform the test printing. The print engine 12 then performs the printing of the first one copy of a print job, and finally enters a standby state. At the same time, the user name in the user name storing section 42 and file name information in the file name storing section 55 are stored into the test printing history storing section 57.

If the history of past printing is found, the test printing history deciding section 56 notifies the test printing controller 32 that the test printing will not be performed but the remaining quantity of output of the print job will be performed. At the same time, the user name in the user name storing section 42 and the file name information in the file name storing section 55 are stored into the test printing history storing section 57.

Subsequently, the test printing controller 32 controls the data reading section 31 so that the data reading section 31 reads image data for one copy of a print job, and the print engine 12 prints the image data and then enters a standby state. That is, under the control of the test printing controller 32, the data reading section 31 reads the image data from the image storing section 24, and then transfers the image data to the print engine 12 through the print engine interface 33. Finally, the print engine prints the image data and then enters the standby state. The test printing controller 32 notifies the test printing history storing section 57 that the test printing for the print job was performed, and the test printing history storing section 57 updates the test printing information.

The remaining operation is the same as that of the fifth embodiment and the description of it is omitted.

The following is a brief description of the flowchart illustrated in FIGS. 15 and 16.

Step S91: The host apparatus 11 transmits the data to the printer 10.

Step S92: The total-quantity-of-output detector 23 obtains the information on the total-quantity-of-output.

Step S93: The image input port 22 obtains the type of print medium.

Step S94: The test printing history deciding section 56 reads current user-name information from the user name storing section 42.

Step S95: The test printing history deciding section 56 obtains the file name information from the file name storing section 55.

Step S96: The image input port 22 obtains image data.

Step S97: The image storing section 24 stores the image data.

Step S98: The test printing deciding section 29 obtains the reference quantity from the reference quantity storing section 28.

Step S99: A check is made to determine whether the total-quantity-of-output is larger than the reference quantity. If the answer is YES, then the program proceeds to step S100. If the answer is NO, the program proceeds to step S104.

Step S100: Logging information is checked for the same user and the same file. If the same user and the same file are not found in the logging information, program proceeds to step S101. If the same user and the same file are found in the logging information, program proceeds to step S106.

Step S101: The print engine 12 prints the first one copy of the print job and then enters the standby state.

Step S102: The timer managing section 38 activates a timer 39.

Step S103: A test printing notifying section 34 notifies the host apparatus 11 that the test printing will be performed and that the printer 10 will enter a standby state.

Step S104: A check is made to determine whether the user's permission storing section 27 holds print permission for the remaining quantity of output. If the answer is YES, then the program proceeds to step S106. If the answer is NO, then the program proceeds to step S105.

Step S105: A check is made to determine whether the user's permission storing section 27 holds the "print cancel" of the remaining quantity of output. If the answer is YES, the program ends. If the answer is NO, the program proceeds to step S107.

Step S106: The remaining quantity of output is printed and then the operation completes.

Step S107: A check is made to determine whether the output of the timer 39 is larger than a predetermined time length. If the answer is YES, the program proceeds to step S108. If the answer is NO, then the program proceeds to step S109.

Step S108: A check is made to determine whether a time-out processing section 37 holds "cancel after-time-out." If the answer is YES, then the program ends. If the answer is NO, then the program proceeds to step S106.

Step S109: A check is made to determine whether a print request from other users has been received. If the answer is YES, then the program proceeds to step S110. If the answer is NO, the program returns to step S104.

Step S110: A check is made to determine whether an interrupt printing processing section 45 holds "cancel due-to-interrupt." If the answer is YES, the program ends. If the answer is NO, then the program proceeds to step S106.

As described above, the image data controller 20 of the printer 10 includes the file name detector 54, file name storing section 55, test printing history deciding section 56, and test printing history storing section 57. The file name detector 54 detects the file name of the data received from a host apparatus 11. The file name storing section 55 stores the detected filename. The test printing history deciding section 56 determines whether test printing was performed for the received data in the past logging information. The test printing history storing section 57 stores information on the test printing that has been performed or not performed, and logging information such as user name and fine name. This configuration provides efficient judgment on whether the test printing that has been performed or not performed, and therefore improves the overall throughput of the printer 10.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A printer that processes print information received from a host apparatus, the printer comprising:

an image storing section that stores image data produced from the print information;

a printing section that prints the image data;

a total-quantity-of-output detector that determines a total quantity of output that should be printed out;

a reference quantity storing section that stores a reference quantity;

a comparing section that compares the reference quantity with the total quantity of output to determine whether the total quantity of output is larger than the reference quantity;

a control section that controls said printing section, wherein if the total quantity of output is larger than the reference quantity, said control section reads a fraction of the image data from said image storing section and causes said printing section to perform test printing where said printing section prints the fraction of the image data and then enters a standby state in which said printing section waits for a rest of the image data.

2. The printer according to claim 1, wherein the total quantity of output is a total number of copies of the image data that should be printed and the fraction of the image data is a copy of the image data that should be printed.

3. The printer according to claim 1, further comprising a user's permission storing section that obtains a user's command after said printing section enters the standby state, wherein said control section controls said printing section to print the rest of the image data in response to the user's command.

4. The printer according to claim 1, further comprising a user's permission storing section that obtains a user's command after said printing section enters the standby state, wherein said control section controls said image storing section to erase the rest of the image data in response to the user's command.

5. The printer according to claim 1, further comprising a test printing notifying section that notifies the host apparatus that test printing is performed, and that the printer enters a standby state after the test printing.

6. The printer according to claim 1, further comprising an operation section through which a user sets the reference quantity.

7. The printer according to claim 1, further comprising an input section through which the reference quantity is received from a host apparatus;

a reference quantity detecting section that stores the reference quantity received through said input section, wherein said storing section stores the received reference quantity into said reference quantity storing section.

8. The printer according to claim 1, further comprising a timer that starts timing when said printing section enters the standby state, wherein when the timer reaches a time, said control section controls said printing section to print the rest of the image data.

9. The printer according to claim 1, further comprising a timer that starts timing when said printing section enters the standby state, wherein when the timer reaches a time, said control section controls said image storing section to erase the rest of the image data.

10. The printer according to claim 1, wherein when said printing section is in the standby state, if the printer receives image data from another user, said control section erases the rest of the image data.

11. The printer according to claim 1, wherein when said printing section is in the standby state, if the printer receives print information from another user, then said control section controls said printing section to print the rest of the image data.

12. The printer according to claim 1, further comprising:

a medium-type detecting section that detects a type of print medium from the image data;

a medium-type selecting section that selects the type of print medium whose reference quantity is stored into said reference quantity storing section; and a reference quantity setting section that sets the reference quantity to said reference quantity storing section;

wherein said reference quantity storing section notifies said comparing section of the received reference quantity that corresponds to the type of print medium detected by said medium-type detecting section.

13. The printer according to claim 1, further comprising a file name detecting section that detects a name of a data file received from the host apparatus;

a file name storing section that stores the name of the data file;

a user-name detector that obtains information on a user;

a user-name storing section that stores information on the user;

a test printing history storing section that stores history information on previously performed test printing; and a test printing history deciding section that decides whether the test printing should be performed.

* * * * *